US005253493A

United States Patent [19]

Ohashi

[11] Patent Number: 5,253,493

[45] Date of Patent: Oct. 19, 1993

[54] WASHING MACHINE HAVING A SINK

[76] Inventor: Shigeo Ohashi, 5-20 Okusawa 1-chome, Setgaya-ku, Tokyo, Japan

[21] Appl. No.: 836,232

[22] Filed: Feb. 18, 1992

[51] Int. Cl.[5] ..... D06F 35/00

[52] U.S. Cl. ..... 68/4; 4/644; 68/196; 220/331; 312/228; 312/323

[58] Field of Search ..... 68/3 R, 13 R, 196, 4; 134/115 R, 115 G; 220/329, 331; 4/619, 627, 630, 638, 644; 312/228, 323

[56] References Cited

U.S. PATENT DOCUMENTS

| | | | |
|---|---|---|---|
| 1,014,831 | 1/1912 | Long | 134/115 R X |
| 1,575,942 | 3/1926 | Schauman | 68/196 |
| 2,979,223 | 4/1961 | Rideout | 220/331 |
| 3,026,699 | 3/1962 | Rhodes | 68/196 X |
| 3,209,560 | 10/1965 | Shelton | 68/4 |
| 3,514,330 | 5/1970 | Schaap et al. | 134/115 R |
| 4,889,257 | 12/1989 | Steffes | 220/331 |

FOREIGN PATENT DOCUMENTS

| | | | |
|---|---|---|---|
| 0075089 | 3/1991 | Japan | 68/13 R |
| 404785 | 1/1934 | United Kingdom | 68/196 |

*Primary Examiner*—Philip R. Coe

*Attorney, Agent, or Firm*—Birch, Stewart, Kolasch & Birch

[57] ABSTRACT

A combination of a washing machine and a sink has a basin-shaped lid member connected to the opening portion formed above the rotary basket, by means of a link mechanism. The link mechanism is composed of, for example, an arm, a first shaft connecting one end of the arm to the lid member, and a second shaft connecting the other end of the arm to a groove provided at the opening portion and being slidable in the groove. Therefore, the lid member can be turned over without coming into contact with the rotary basket or the clothes therein, in order to use the lid member as a sink.

7 Claims, 3 Drawing Sheets

WASHING MACHINE HAVING A SINK

BACKGROUND OF THE INVENTION

1. Field of the Invention

The present invention relates to a washing machine and a sink and, more particularly, to a combination of a washing machine and a sink wherein a rotating basket for containing clothes or the like and a sink to be used for shaving, washing a face, hair, etc. are assembled in one casing.

2. Description of Related Art

Effective use of a limited space is one of the key issues to living comfortably in a small house or apartment. Most of the people living in such a housing condition do care about limiting the amount or bulk of furniture and household appliances and arranging them concisely in the limited space.

On the other hand, some family members may often find the bathroom occupied and have to wait in the busy morning hour. In such a case, they may wish for an extra place for shaving, washing a face, etc.

SUMMARY OF THE INVENTION

It is an object of the present invention to provide an appliance which provides a place for washing a face, hair, etc. and yet saves space.

To achieve the above object, a washing machine having a sink according to the present invention comprises a casing, a cylindrical rotary basket provided in the casing, and a lid formed like a basin, i.e. having a concave surface at one side thereof, and rotatably connected by a link means to the opening formed at a top portion of the casing, i.e. above the rotary basket.

Thus, the present invention provides a combination of a washing machine and a sink for washing a face, manually washing clothes, etc. The basin-shaped lid, i.e. the sink, can be turned over for use as a lid or as a sink. Since most houses and apartments have plumbing installed for a washing machine, the sink incorporated into the washing machine usually does not require its own extra plumbing but can be connected to the pipes for the washing machine. There should be almost no occasion when it is desired that both the washing machine and the sink incorporated thereto be used at the same time. On the other hand, there should be many occasions when a family member has to wait for his turn to use a sink, as mentioned above. The present invention solves such a problem by providing an extra sink without taking up extra space.

DESCRIPTION OF THE PREFERRED EMBODIMENTS

Figure 1:
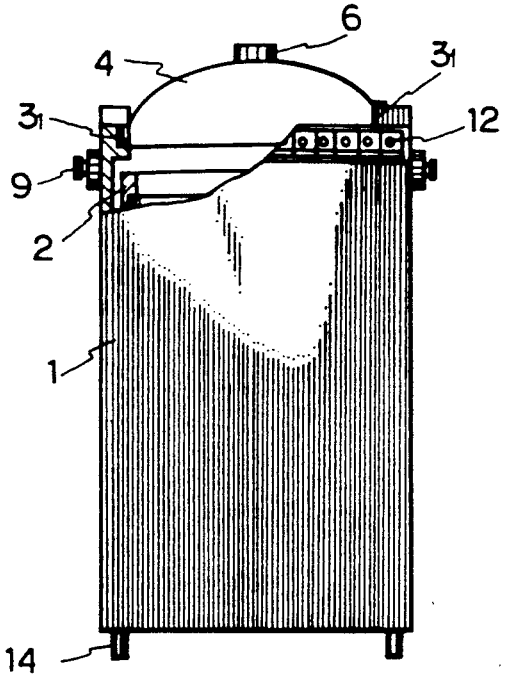
FIG. 1 is a partially sectional front view of a washing machine having a sink according to one embodiment of the present invention, wherein the lid member is positioned to be used as a lid.

For a better understanding of the present invention, the preferred embodiments of the present invention will be described in detail hereinafter with reference to the drawings.

Referring to FIGS. 1 to 5, a rotary basket 2 is rotatably mounted in a casing 1. Clothes (not shown) are put into the rotary basket 2 through an opening 1*a*.

A lid member 4 is connected by a link means 3 to the inside surface of the casing 1, close to the opening 1*a*. The lid member 4 is rotatable and movable up and down. The link means 3 is composed of: arms $3_1$; a shaft $3_2$ connecting one end of each arm $3_2$ to the lid 4; and a shaft $3_3$ connecting the other end of each arm $3_1$ to the inside surface of the casing 1. Alternatively, the arms $3_1$, the lid member 4 and the inside surface of the casing 1 may be connected by projection-recess engagement.

Figure 3:
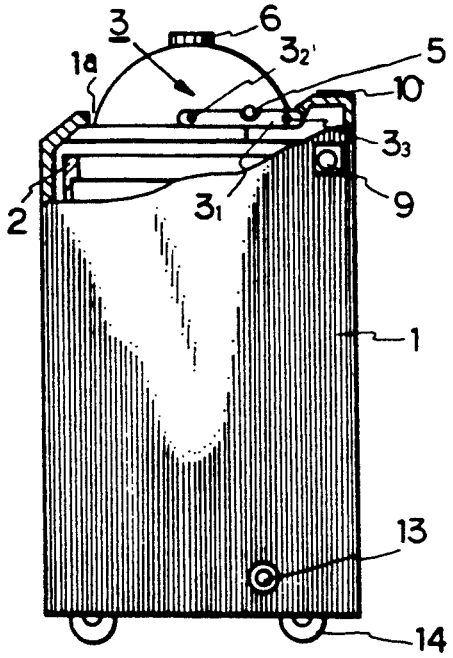
FIG. 3 is a partially sectional side view of what is shown in FIG. 1.
Figure 2:
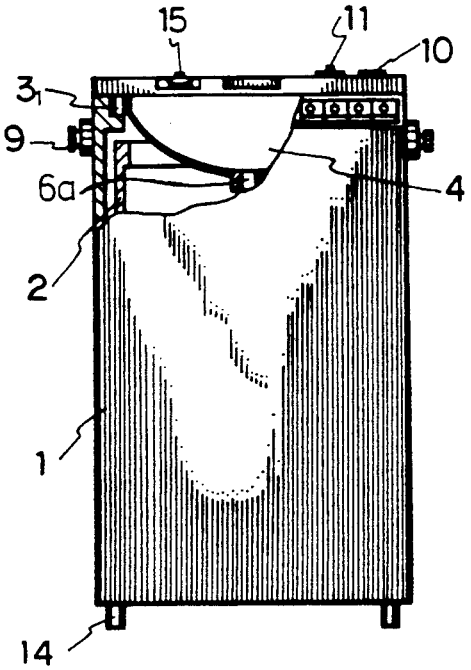
FIG. 2 is a partially sectional front view of the washing machine having the sink shown in FIG. 1, wherein the lid is positioned to be used as a sink.
Figure 5:
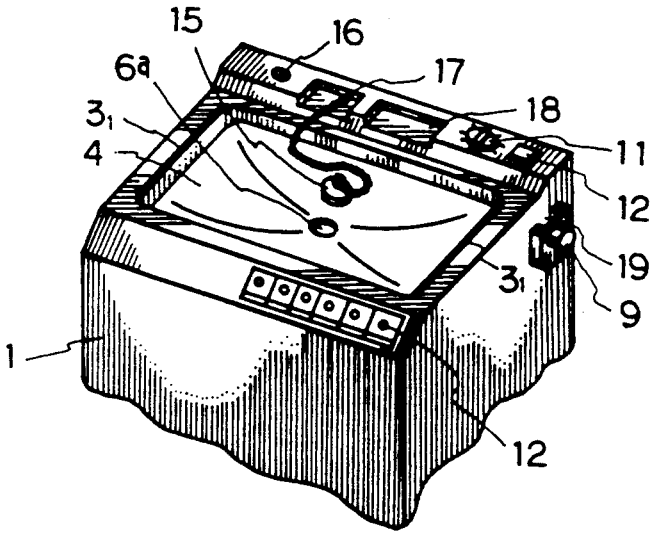
FIG. 5 is a perspective view of the main portion of the washing machine having the sink, wherein the lid is positioned to be used as a sink.

The lid member 4 is formed like a basin, having a concave surface at one side and a convex surface at the other side. The lid member 4 functions as a lid when it is positioned so that the convex surface faces upward, as shown in FIG. 1 and 3. It functions as a sink when the concave surface faces upward, as shown in FIG. 2 and 5. The lid member 4 is provided with a handle 6 for handling the lid member 4. A drain 6*a* is formed in the handle 6. A stopper 15 for the drain 6*a* is connected to the casing 1 by a chain 17.

The lid member 4 is rotatable 360° about the shafts $3_2$. Each of the arms $3_1$ is also rotatable about the shaft $3_3$, but is stopped at the horizontal position by an arm stopper 7 provided at an upper portion of the inside surface of the casing 1. Thus, the arms $3_1$ are rotatable down to the horizontal position and do not rotate down farther. Lid stoppers 5 are provided on both outer sides of the lid member 4. Each of the lid stoppers 5 engages with a recess 3*a* formed on each of the arms $3_1$ when the lid member 4 is positioned to be used as a lid of the washing machine, and engages with a recess 7*a* formed on each of the arm stoppers 7 when the lid member 4 is positioned to be used as a sink. Thus, the lid member 4 is set at the proper position in either of the cases.

Figure 4:
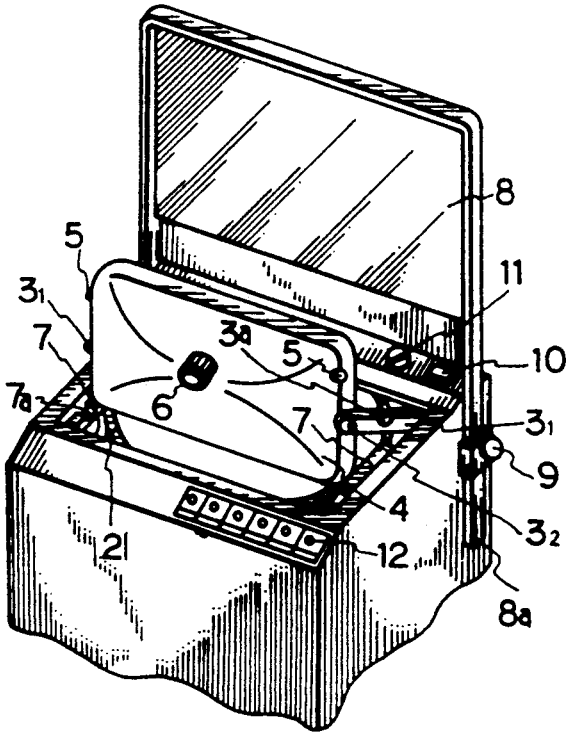
FIG. 4 is a perspective view of the main portion of the washing machine having the sink shown in FIG. 1.

To avoid a contact between the lid member 4 and the rotary basket 2 when the lid member 4 is turned over for the other function thereof, the arms $3_1$ are pivoted upward about the shafts $3_3$ to lift the lid member 4 before turning over the lid member 4, as shown in FIG. 4. While held high by the arms $3_1$, the lid member 4 is rotated 180° counterclockwise (in FIG. 4) about the shafts $3_2$ to change from the lid position shown in FIGS. 1 and 3 to the sink position shown in FIGS. 2 and 5, and rotated 180° clockwise about the shafts $3_2$ to change the positions the other way around.

A motor or a solenoid may be used to operate the lid member 4 and the link means 3. Then, the functions of the lid member can be changed by a switching operation, instead of a manual operation.

A fixing means for fixing the legs 8*a* of a mirror 8 to the casing 1 with screws 9 is provided at an upper portion of the outside surface of the casing 1. Such a fixing means may be provided on the top surface of the casing 1, instead.

Figure 6:
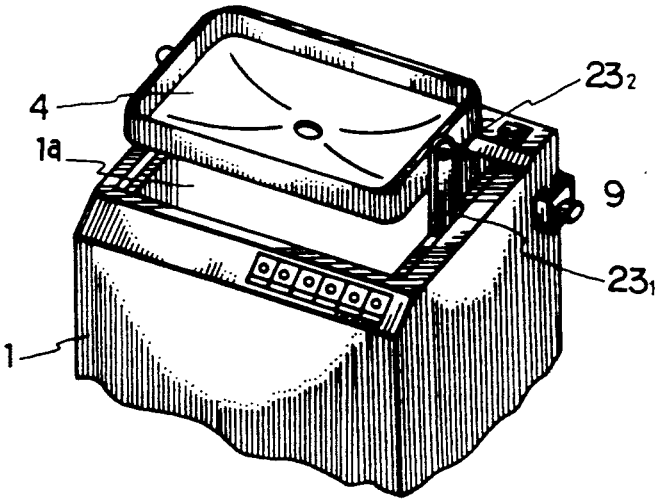
FIG. 6 is a perspective view of the main portion of a washing machine having the sink according to another embodiment of the present invention.

With reference to FIG. 6, according to another embodiment of the present invention, a lid member 4 is rotatably journaled to one end of each of the arms $23_1$ which are movable up and down. To change the functions of the lid member 4: the arms $23_1$ are moved upward to raise the lid member 4; then the lid member 4 is rotated 180° about shafts $23_2$; and the lid member 4 is brought down to set in position. The other parts are substantially the same as those in the foregoing embodiment.

FIGS. 1 to 5 also show a power switch 10, a water level adjust knob 11, a switch 12, a drain 13, casters 14, a water inlet 16 and a soap dish 18.

Figure 7:
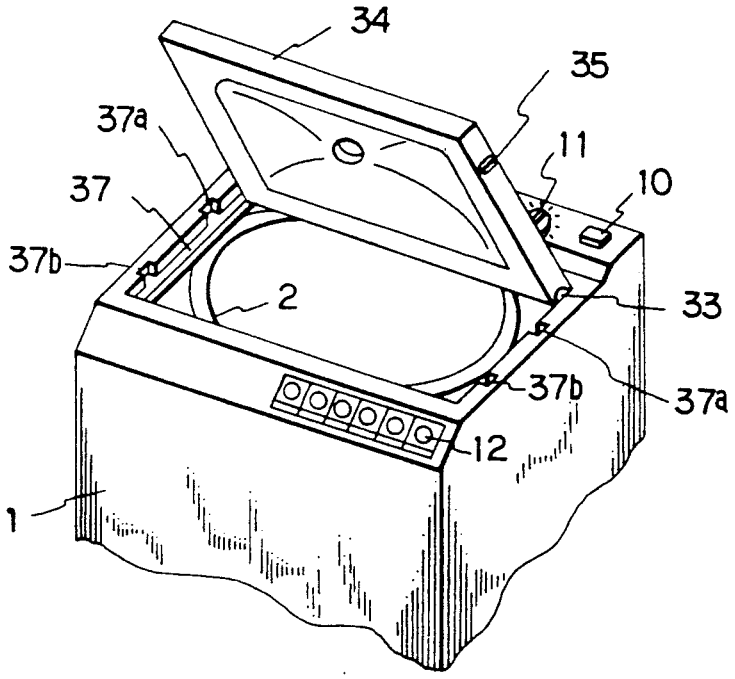
FIG. 7 is a perspective view of the main portion of a washing machine having the sink according to still another embodiment of the present invention.
Figure 8:
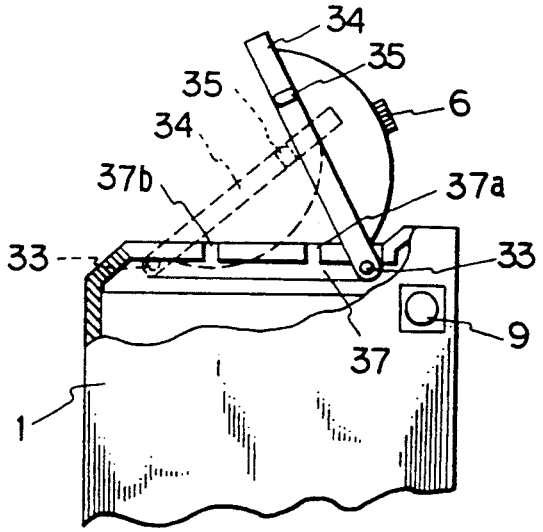
FIG. 8 is a perspective view of the main portion of the washing machine having the sink shown in FIG. 7.

With reference to FIGS. 7 and 8, according to still another embodiment of the present invention, grooves 37 are cut along two facing edges of an opening la of the casing 1 housing a rotary basket 2. Two recesses 37*a*, 37*b* are formed in each of the grooves 37 so as to have openings upwards. A lid member 34 has a shaft 33 provided at a portion off the center (an end portion) of each of two side edges thereof, i.e. the two sides facing the grooves 37. The shafts 33 are slid though the grooves 37 and stopped at the ends of the grooves 37 to function as the center axis (supporting points) for the rotation of the lid member 34. A projection (a stopper) 35 is provided at an appropriate portion of each of the two side edges of the lid member 34, i.e. the two side edges having the shafts 33. The projections 35 engage with portions of the grooves 37 when the lid member 34 is set in position. The shafts 33 and the projections 35 can be moved out of the grooves 37 through the recesses 37*a*, 37*b*.

To set the shafts 33 in the grooves 37, the shafts 33 are inserted in the recesses 37*a*, 37*b* and slid through the grooves 37 to the ends thereof. Thus, the lid portion 34 can be easily opened and closed as the lid of the washing machine, and it can be also turned over to change its functions, from the lid to a sink and from sink to lid, by sliding the shafts 33 along the grooves 37.

With reference to FIG. 8, the above operation will be further described in detail. The shafts 33 of the lid member 34 are inserted through the recesses 37*a* or 37*b* into the grooves 37. When the lid portion 34 is used as the lid of the washing machine, it is slid along the grooves 37 to a position where the shafts 33 are stopped at the right ends of the grooves 37, as illustrated by solid lines in FIG. 8. At this position, the lid member 34 is turned counterclockwise to set it in the lid position, with the projections 35 being inserted through the recesses 37*b* and fitted in the grooves 37. When the lid member 34 is used as as a sink, the shafts 33 are slid to the position where the shafts 33 are stopped at the left ends of the grooves 37, as illustrated by broken lines in FIG. 8. Then, the lid member 34 is turned clockwise to the sink position, with the projections 35 being inserted through the recesses 37*a* and fitted in the grooves 37.

The embodiment illustrated in FIGS. 7 and 8 may be modified as below. Instead of the shafts 33 directly mounted to the two sides of the lid member 34, shafts having springs (not shown) may be inserted in holes formed on the two sides of the lid member 34. Such shafts can be set in the grooves 37 by pushing the shafts into the holes. With this modification, the recesses 37*a*, 37*b* of the grooves 37 are unnecessary.

Further, while the grooves 37 are formed along two edges of the casing 1 surrounding the opening la in the above embodiment, a structure having grooves equivalent to the grooves 37 may be separately provided and mounted to a top portion of the inside surface of the casing 1.

According to still another embodiment of the present invention, a lid member having the functions of a sink as well as the lid of a washing machine is provided with an adaptor structure ( not shown) with which the lid member can be installed on a conventional washing machine instead of the original lid thereof.

The present invention has the following advantages:

(1) Since the the lid member of the washing machine having a convex side and a concave side is rotatably connected to the opening portion by means of the shafts with which the lid member can be raised as shown in FIG. 4, the lid member can be easily turned over to become a sink without coming into contact with the rotary basket or clothes therein.

(2) Since a sink is incorporated into a washing machine, the space is saved.

(3) The installation cost (cost for installing a faucet and a drain) is reduced since the sink incorporated into the washing machine does not require its own extra plumbing but can be connected to the existing plumbing for a washing machine.

(4) Since rotation stopping projections are provided on both the periphery of the lid member and the periphery of the opening portion of the casing, or either one of them, the lid member movement (rotation) is stopped at the designated positions, i.e. the lid position and the sink position.

(5) Since the means for fixing the legs of a mirror is provided on either the top surface of the casing or each of the side surfaces thereof, a mirror can be firmly fixed to the casing at a desired height.

(6) According to the embodiment of the present invention as illustrated in FIGS. 7 and 8, the construction can be simplified and operability can be upgraded.

What is claimed is:

1. A washing machine comprising:

a casing member defining exterior dimensions of said washing machine and including an upper opening, front, rear, and opposing side portions;

a cylindrical rotary basket fit within said casing;

a lid member removably provided at the upper opening portion of said casing, said lid including a concave surface on one side thereof and a convex surface on an opposing side thereof in order to function as a sink and as a lid, respectively;

a shaft provided at an end of each of two opposing peripheral sides of said lid member; and a groove provided at each of the two opposing peripheral sides of the opening portion of said casing, said two opposing peripheral sides of the opening portion facing said two opposing peripheral sides of the lid member, and wherein said lid member can be turned over by sliding each shaft in a corresponding groove.

2. The washing machine according to claim 1, further comprising: a recess formed within each of the grooves; and a projection provided on each of said two opposing peripheral sides of the lid member, said projections being provided at positions of said recesses, and wherein said projections are inserted through said recesses into said grooves and function as stoppers in the grooves thereby controlling a position of said lid.

3. A washing machine comprising:

a cylindrical rotary basket provided within a casing of said washing machine;

a lid member having a concave face defining a sink on one major surface thereof and a corresponding convex face on an opposing major surface thereof, said lid member being removably fitted to an opening portion of said casing above the rotary basket;

a drain formed within said lid member; and a turnover mechanism connected to both said lid member and said casing for turning said lid member over for alignment of either of the concave face or the convex face with said cylindrical rotary basket.

4. The washing machine according to claim 3, wherein said turnover mechanism includes an arm connecting opposing sides of said lid member and corresponding opposing sides of said casing, a first shaft rotatably connecting one end portion of each arm to the lid member, and a second shaft rotatably connecting the other end portion of each arm to an inside surface of said casing.

5. The washing machine according to claim 4, wherein said casing is provided with a stopper for stopping said arms at a horizontal position so that the arms do not retract below a horizontal plane and wherein a stopper includes a projection removably fit within a corresponding recess.

6. The washing machine according to claim 3, wherein said turnover mechanism includes pivot members provided at portions off center on opposing sides of said lid member for mating with guiding grooves mounted on said casing and opposing the pivot members of said lid member, whereby said lid member is invertible by sliding said pivot members along said guiding grooves.

7. The washing machine according to claim 6, wherein said pivot members are shafts slidable along said guiding grooves.

* * * * *